US012065753B2

(12) United States Patent
Egli et al.

(10) Patent No.: US 12,065,753 B2
(45) Date of Patent: Aug. 20, 2024

(54) METHOD AND COMPOSITION FOR SELECTIVE ANODIZATION

(71) Applicant: Aalberts Surface Technologies GmbH, Kerpen (DE)

(72) Inventors: André Egli, Kriens (CH); Georg Andersohn, Ranstadt (DE); Julia Dukwen, Erkelenz (DE); Frédéric Cours, Porcelette (FR)

(73) Assignee: Aalberts Surface Technologies GmbH, Kerpen (DE)

( * ) Notice: Subject to any disclaimer, the term of this patent is extended or adjusted under 35 U.S.C. 154(b) by 0 days.

(21) Appl. No.: 18/062,359

(22) Filed: Dec. 6, 2022

(65) Prior Publication Data

US 2023/0323557 A1 Oct. 12, 2023

(30) Foreign Application Priority Data

Dec. 9, 2021 (EP) ..... 21213523

(51) Int. Cl.
*C25D 11/00* (2006.01)
*C25D 11/02* (2006.01)

(52) U.S. Cl.
CPC ..... *C25D 11/022* (2013.01); *C25D 11/024* (2013.01)

(58) Field of Classification Search
None
See application file for complete search history.

(56) References Cited

U.S. PATENT DOCUMENTS

2015/0083603 A1* 3/2015 Yoshida ..... C25D 11/022 205/134

FOREIGN PATENT DOCUMENTS

| | | | |
|---|---|---|---|
| DE | 10140934 | A1 | 2/2003 |
| EP | 1219464 | A2 | 7/2002 |
| FR | 2490685 | A1 | 3/1982 |
| FR | 2574095 | A1 | 6/1986 |
| GB | 2012814 | A | 8/1979 |

OTHER PUBLICATIONS

English translation FR2490685 (Year: 1982).*
English translation EP0202870 (Year: 1986).*
English translation GB2146043 (Year: 1985).*
Kaseem et al. "Incorporation of MoO2 and ZrO2 particles into the oxide film formed on 7075 Al alloy via micro-arc oxidation", Materials Letters, 182, 2016 (Year: 2016).*
Kanagaraj et al. "Effect of addition agents on anodizing of aluminum and its alloys in sulphamic acid using pulse technique", J. Electrochem Soc. India vol. 48-3, 1999, p. 222-227. (Year: 1999).*

* cited by examiner

*Primary Examiner* — Stefanie S Wittenberg

(74) *Attorney, Agent, or Firm* — Gardner, Linn, Burkhart & Ondersma LLP

(57) ABSTRACT

A composition for selective anodization, comprising the substances amidosulphuric acid, magnesium sulphate and concentrated sulphuric acid as a base electrolyte and additionally sodium stannate and/or molybdenum oxide. A corresponding method of selectively anodizing a substrate or workpiece includes providing a substrate having a surface which is to be selectively coated, where the substrate is arranged in a tool and forms a coating cell, selectively bathing the surface with the composition for selective anodization, and applying an electric current between substrate (anode) and tool (cathode) for selective anodization of the surface.

20 Claims, 3 Drawing Sheets

METHOD AND COMPOSITION FOR SELECTIVE ANODIZATION

CROSS REFERENCE TO RELATED APPLICATION

The present application claims the priority benefits of European patent application no. 21213532.0, filed Dec. 9, 2021.

BACKGROUND AND FIELD OF THE INVENTION

The invention relates to a composition for selective anodization, including selective anodization of a substrate, such as a workpiece.

The process of selective anodization is an electrochemical method for surface coating. Anodization is effected—as illustrated schematically in FIG. 1—in special tools 2 adapted to the respective component. This tool, including the component surface 1 and correspondingly connected peripheral devices, constitutes the actual coating cell 6. The tool simultaneously assumes the function of the cathode 3 and the sealing, i.e. surface regions which are not to be anodized are sealed or masked and entry of the electrolyte is thus prevented. As a result, no layer formation takes place in these regions, but instead only the bathed region is selectively anodized. Sealing elements are not illustrated for the sake of clarity. Depending upon the component geometry of the surface to be anodized, as well as for functional reasons and handling capability, the tool can consist of a plurality of sections which are brought into position via the movement paths indicated by way of example by double arrows in order to seal and produce the closed coating cell. The tool is also used to simultaneously transport the electrolyte (supply and discharge) and introduce the current required for the anodization by means of a suitable current source (connection via anode or cathode). The electrolyte flow rate is generated from the electrolyte tank 5 via a pump 4 and maintained for the duration of the anodization. Depending upon the coating requirements, the electrolyte is additionally heated or cooled.

This selective anodization is known. For example, DE 101 40 934 A1 describes a similar apparatus and a method for the galvanic surface treatment of workpieces having a closed process chamber for receiving a workpiece, which has at least one supply opening for the supply of process liquid into the process chamber and at least one discharge opening for the discharge of process liquid, wherein at least one electrode which can be connected to a current source is provided and the workpiece can be connected as a counter-electrode to a current source of opposite polarity, and having means for generating a flow of the process liquid through the process chamber along a treatment surface of the workpiece to be treated, wherein a plurality of supply openings and a plurality of discharge openings are arranged spaced apart from the treatment surface and a discharge opening and a supply opening are each arranged adjacent one another. FR 2 574 095 A1 likewise already describes such a system and method.

The use of the method described in this case offers advantages over conventional anodization in dipping baths: (i) high sustainability through partially targeted functionalisation; (ii) low material usage (such as e.g. systems technology, racks, chemistry); (iii) short coating duration; (iv) low layer roughness; (v) no pre-treatment and post-treatment; (vi) closed circuit system; and (v) component-related process monitoring.

However, previous systems often use chromic acid or chromium trioxide-containing electrolytes (compositions) in order to achieve good coating results. For example, EP 1 219 464 A1 describes in paragraph [0264] the use of chromic acid. The use of chromium trioxide-containing compositions, however, is no longer desirable by reason of the health risks and its use within the framework of the regulations of the European Chemicals Directive is only possible after approval of a corresponding application for authorization which establishes the safe handling and the lack of alternatives for this use.

SUMMARY OF THE INVENTION

The present invention provides a composition for selective anodization which permits properties of the layer produced on the substrate, which are the same or better than those which can be achieved with a chromium trioxide-containing composition. Moreover, the present invention provides a corresponding method for selective anodization using such a composition. In particular, the coatings are to be as smooth as possible, i.e. have a low roughness, in spite of the omission of chromium trioxide whilst short coating times are maintained.

In accordance with aspects of the invention, an improved composition for selective anodization is provided which, in spite of the omission of chromium trioxide, produces (hard) anodic layers which have a low roughness while short coating times are maintained. In accordance with particular aspects of the invention, the present invention provides an electrolyte which is used for the aforementioned selective high-speed anodization. A particular challenge was the substitution of chromium trioxide. In this case, it was necessary to ensure that a (hard) anodic layer (>5 μm, >250 HV 0.01) with as little roughening as possible and the shortest coating time was combined. In order to achieve this, a base electrolyte was developed which is characterized by rapid layer growth even at relatively low voltages. It is understood by the inventors that the reasons for this are, on the one hand, the dependence upon roughening and pore size in relation to the applied voltage and electrolyte temperature and, on the other hand, the direct correlation of the roughening in relation to the coating time. To summarize: the shorter the coating time, the smoother the resulting layer (with the same layer thickness). Depending upon the electrolyte composition and conductivity, advantages are also achieved at higher voltages in conjunction with lower electrolyte temperatures, wherein, in direct comparison, lower temperatures also result, in turn, in higher coating times.

The base electrolyte used within the scope of the invention consists of sulphuric acid, magnesium sulphate and amidosulphonic acid, with which in a short time sufficient layer thicknesses were obtained which had appealing, but not always sufficient, roughness values. The base electrolyte contains preferably concentrated sulphuric acid in a range from 5 to 150 g/L, magnesium sulphate hydrate from 5 to 200 g/L and amidosulphonic acid from 5 to 200 g/L.

The inventors have established that, in addition to the coating time and the applied voltage (the resulting current density), the solubility of trivalent aluminium in the anodization medium also plays a decisive role in the resulting roughness. By reason of the direct transfer of $Al^{3+}$ into the solution, the anodic current yield in relation to the aluminium oxide formation is reduced, whereby the coating time is extended, with correspondingly negative effects upon the roughness. In addition, the back-dissolution of already formed aluminium oxide, which is naturally favoured when using a medium which dissolves $Al^{3+}$ effectively, enlarges the pores in the layer, which is associated with a corresponding roughening of the layer. One way of reducing the solubility of Al(III) is to capture it as it attempts to exit the substrate and instead force it to be incorporated into the layer.

The inventors assume that, with a certain level of probability, this is exactly how chromic acid functions, since the anodized layers produced from chromic acid electrolytes contain chromium, which in turn is assumed to be incorporated into the layer as aluminium chromate. Conversely, this means that the chromic acid captures Al(III) species exiting from the substrate and the latter participates in the form of a hetero-polyoxometalate in the layer build-up. Since chromic acid itself has a tendency to form oligomers, compounds exhibiting a reactivity related to chromic acid were selected as possible chromium substitutes. According to the assumption of the inventors, alternatives are accordingly metal oxides which preferably have high nuclear charges (but not nuclear charges which are excessively high and thus prevent the formation of polyoxometalates), i.e. early and intermediate transition metal oxides (preferably group 5 and 6), but also main group metal and semi-metal oxides in their high oxidation states.

Specifically, these are the oxides of the high oxidation states of metals which are in the immediate vicinity of chromium, i.e. vanadium(V) oxide and its vanadates and polyvanadates derived therefrom. Furthermore, the heavier congeners of groups 5 and 6, e.g. molybdenum(VI) oxide, molybdates and polymolybdates, niobium(V) oxide and tantalum(V) oxide and the derivatives thereof, tungsten(VI) oxide, tungstates and polytungstates.

In a similar manner to the transition metals, the nuclear charge also plays a decisive role in the formation of polyoxometalates in the main group metals. Correspondingly, according to the assumption of the inventors, the oxides of elements such as gallium, germanium, indium, tin, lead and bismuth are recommended for possible use in acid anodizing electrolytes, wherein lead was not considered for obvious reasons.

It has now been shown that these classes of substances actually have a very advantageous influence on the roughness of the (hard) anodic layer, without the layer hardness and the layer thickness growth (coating duration) being negatively influenced.

In particular, it has been found that molybdenum oxides and stannates are highly suitable. In the specific case, both $MoO_3$ (with and without water of crystallisation), $Na_2MoO_4*2H_2O$, and $Na_2SnO_3*3H_2O$ (correctly $Na_2[Sn(OH)_6]$) demonstrate a pronounced reduction in the surface roughness with the same anodized layer thickness and hardness as well as comparable coating time.

Since sodium stannate ($Na_2[Sn(OH)_6]$) in non-alkaline aqueous solution has a pronounced tendency to precipitate as β-stannic acid (hydrated tin(IV) oxide), the stannate was previously converted into the corresponding carboxylate in a dicarboxylic acid solution, such as oxalic acid, malonic acid or succinic acid, without isolating the reaction product.

Each of the above-mentioned compounds led in their own right to the described reduction in roughness, but it has been demonstrated that the effects of molybdenum(IV) oxide and sodium stannate add up, and so in particular the corresponding combination provides results which are equivalent to the chromic acid-containing methods.

Added to the base electrolyte are 0.1 to 100 g/L sodium stannate, preferably pre-dissolved in 5 to 100 g/L dicarboxylic acid, and/or 0.1 to 100 g/L molybdenum(VI) oxide, wherein it is to be noted that higher concentrations of the latter only dissolve completely during the anodizing under certain circumstances.

The aforementioned base electrolyte and said chemical compounds were operated under the conditions of high-speed anodization.

In accordance with an aspect of the invention, the current density is in the range of 10 A/dm$^2$ to 500 A/dm$^2$, the temperature is between −5° C. and 55° C., and the flow rate is in the range of 0.1 m$^3$/h and 15 m$^3$/h. The coating duration is between 5 and 60 s. The applied voltage is between 10 V and 120 V, wherein this voltage can be present as a DC voltage or a pulsed voltage (unipolar).

With said method and the aforementioned electrolyte composition, it is possible in this manner to produce layers by anodization, specifically aluminium alloys and also aluminium casting alloys having high silicon contents. The layers produced which protect against wear and corrosion have only a slightly higher roughness compared with the non-anodized surface. Depending on the alloy and the surface state before anodization, e.g. a roughness Ra<0.8 can be achieved with the described method (even with high silicon contents of e.g. 12 wt. %). The achieved roughness of the layers produced with the composition in accordance with the invention is preferably in the range Ra<0.8, more preferably <0.6, most preferably <0.4, in dependence upon the initial roughness before anodization and depending upon the aluminium alloy to be anodized.

The invention describes a method for selective anodization of aluminium surfaces. Specifically, a method is described which is free of chromium trioxide (chromium (VI) oxide) without losing any of the advantages of the conventional chromium(VI) oxide-containing method.

In summary, the advantages of the invention include the unrestricted possibility of selective anodization in a coating cell with a short coating duration (<60 s) as well as the required layer properties such as layer thickness (>5 μm), hardness (>250 $HV_{0.01}$) and roughness Ra<0.8.

DESCRIPTION OF THE PREFERRED EMBODIMENTS

The following examples are used for the purpose of explaining the invention. The following examples of high-speed anodization serve to demonstrate the use of the electrolyte compositions in accordance with the invention and thus the possible replacement of chromium trioxide-containing electrolytes without losing the technically required minimum layer features.

Figure 1:
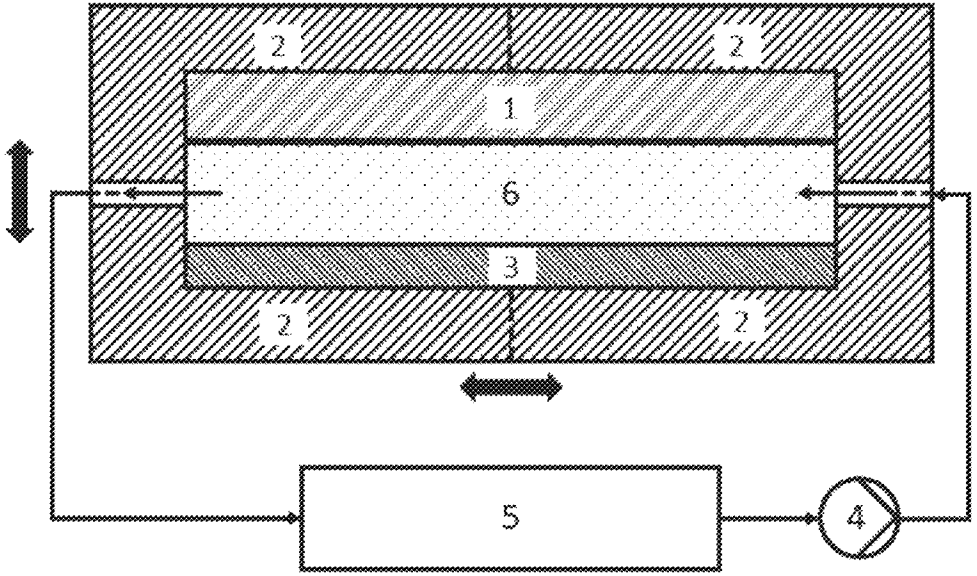
FIG. 1 is a schematic illustration of a tool for selective anodization.

The selective anodization was effected according to the structure as described initially and shown in FIG. 1, with variation in the alloys described hereinafter as well as the inventive electrolyte compositions and process parameters. The comparative examples were also performed in the same way. Round flat samples of the respective alloy were used as samples. The measurement of the different roughness characteristic variables served to determine the roughening caused by the anodization and was performed before and after anodization by means of a tactile testing device from the company Perthen or Mahr in accordance with DIN EN ISO 4287.

The layer hardness was measured according to Vickers with a device from the company Matsuzawa MMT-X 7B in accordance with DIN EN ISO 4516, DIN EN ISO 4545-1 and DIN EN ISO 6507-1:2018. The layer thickness was determined on the cross-section polish using a Polyvar Met. microscope in accordance with DIN ISO 1463.

Comparative Example 1: Anodization of EN AC-Al Si12 with Chromium Trioxide-Containing Electrolyte The following reference values are given for said material with a sulphuric acid-based and chromium trioxide-containing electrolyte. The anodization was effected with the following parameters:

Flow rate: 7.3 $m^3/h$
Temperature: 26° C.
Voltage: 46 V
Current density: 340 $A/dm^2$ (start), 40 $A/dm^2$ (end)
Anodization duration: 48 s)

TABLE 1

Layer properties with chromium trioxide-containing electrolyte, comparative example 1

| Hardness | Layer thickness | Roughness | | | | | | | |
|---|---|---|---|---|---|---|---|---|---|
| | | Ra | | Rz | | Rpk | | Rmax | |
| HV 0.010 | in μm | Before | After | Before | After | Before | After | Before | After |
| >300 (360) | ca. 12 | 0.037 | 0.609 | 0.321 | 3.396 | 0.055 | 0.431 | 0.401 | 4.226 |

Comparative Example 2: Anodization of EN AC-Al Si12 with Chromium Trioxide-Free Electrolyte The following reference values are given for said material with a sulphuric acid-based and chromium trioxide-free electrolyte (base electrolyte of the electrolytes in accordance with the invention). The anodization was effected with the following parameters:

Flow rate: 3.0 $m^3/h$
Temperature: 10° C.
Voltage: 40 V (unipolar, pulsed with 10 Hz [60 ms pulse/40 ms pause])
Current density: 393 $A/dm^2$ (start), 21 $A/dm^2$ (end)
Anodization duration: 6 s)

TABLE 2

Electrolyte composition for high-speed anodization, chromium trioxide-free electrolyte, comparative example 2

| Designation | Comparative example 2 Quantity in g/l |
|---|---|
| Amidosulphuric acid | 100.00 |
| Magnesium sulphate heptahydrate | 100.00 |
| Sulphuric acid conc. | 38.5 |

TABLE 3

Layer properties with chromium trioxide-free electrolyte, comparative example 2

| Hardness | Layer thickness | Roughness | | | | | | | |
|---|---|---|---|---|---|---|---|---|---|
| | | Ra | | Rz | | Rpk | | Rmax | |
| HV 0.010 | in μm | Before | After | Before | After | Before | After | Before | After |
| >300 (360) | 14.5 | 0.06 | 2.29 | 0.50 | 10.62 | | | 0.66 | 12.54 |

Comparative Example 3: Anodization of EN AW-6061 with Chromium Trioxide-Containing Electrolyte The following reference values are given for said material with a sulphuric acid-based and chromium trioxide-containing electrolyte. The anodization was effected with the following parameters:

Flow rate: 2.5 $m^3/h$
Temperature: 26° C.
Voltage: 34 V
Current density: 183 $A/dm^2$ (start), 25 $A/dm^2$ (end)
Anodization duration: 34 s)

TABLE 4

Layer properties with chromium trioxide-containing electrolyte, comparative example 3

| Hardness | Layer thickness | Roughness | | | | | | | |
|---|---|---|---|---|---|---|---|---|---|
| | | Ra | | Rz | | Rpk | | Rmax | |
| HV 0.010 | in μm | Before | After | Before | After | Before | After | Before | After |
| >400 (451) | 7.7 | 0.087 | 0.134 | 0.548 | 0.898 | 0.077 | 0.128 | 0.637 | 1.49 |

Comparative Example 4: Anodization of EN AW-6061 with Chromium Trioxide-Free Electrolyte The following reference values are given for said material with a sulphuric acid-based and chromium trioxide-free electrolyte. The anodization was effected with the following parameters:

Flow rate: 3.0 $m^3/h$
Temperature: 10° C.
Voltage: 55 V (unipolar, pulsed with 10 Hz [60 ms pulse/40 ms pause])
Current density: 432 $A/dm^2$ (start), 51 $A/dm^2$ (end)
Anodization duration: 5 s)

TABLE 5

Electrolyte composition for high-speed anodization, chromium trioxide-free electrolyte, comparative example 4

| Designation | Comparative example 4 Quantity in g/l |
|---|---|
| Amidosulphuric acid | 100.00 |
| Magnesium sulphate heptahydrate | 100.00 |
| Sulphuric acid conc. | 38.5 |

TABLE 6

Layer properties with chromium trioxide-free electrolyte, comparative example 4

| Hardness | Layer thickness | Roughness | | | | | | | |
|---|---|---|---|---|---|---|---|---|---|
| | | Ra | | Rz | | Rpk | | Rmax | |
| HV 0.010 | in μm | Before | After | Before | After | Before | After | Before | After |
| 250 | 18.0 | 0.07 | 0.39 | 0.64 | 2.80 | 0.15 | 0.37 | 1.13 | 3.47 |

Invention Example 1: Anodization of EN AC-Al Si12 with Inventive Electrolyte without Chromium Trioxide The following reference values are given for said material with electrolyte in accordance with the invention. The anodization was effected with the following parameters:

Flow rate: 6.0 $m^3/h$

Temperature: 10° C.

Voltage: 55 V (unipolar, pulsed with 10 Hz [60 ms pulse/40 ms pause])

Current density: 129 $A/dm^2$ (start), 3.2 $A/dm^2$ (end)

Anodization duration: 40 s)

TABLE 7

Electrolyte composition for high-speed anodization, inventive electrolyte without chromium trioxide, invention example 1

| Designation | Invention example 1 Quantity in g/l |
|---|---|
| Amidosulphuric acid | 50.00 |
| Magnesium sulphate heptahydrate | 50.00 |
| Sulphuric acid conc. | 19.25 |
| Oxalic acid dihydrate | 50.00 |
| Sodium stannate trihydrate | 30.00 |
| Molybdenum oxide | 20.00 |

TABLE 8

Layer properties with inventive electrolyte without chromium trioxide, invention example 1

| Hardness | Layer thickness | Roughness | | | | | | | |
|---|---|---|---|---|---|---|---|---|---|
| | | Ra | | Rz | | Rpk | | Rmax | |
| HV 0.010 | in μm | Before | After | Before | After | Before | After | Before | After |
| >300 (415) | 12.25 | 0.307 | 0.493 | 0.59 | 3.272 | — | — | 0.824 | 4.665 |

In accordance with the object of the invention, it is desirable for the increase in roughness (roughening) caused by the resulting anodization layer to be as small as possible. Smaller resulting roughness values after anodization are consequently better. It can be seen that the simultaneous use of sodium stannate and molybdenum oxide (invention example 1) achieves at least roughness values as can also be achieved with chromium trioxide-containing compositions (comparative example 1). The Ra value is considered to be the important measure for this.

Figure 2B:
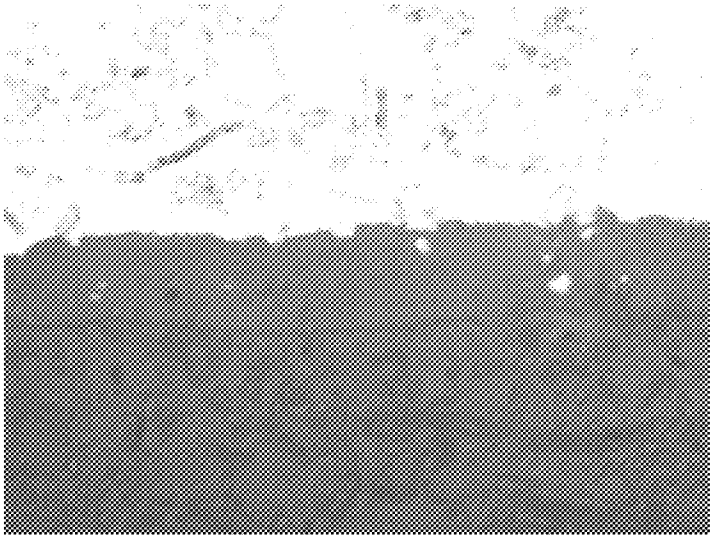
FIGS. 2A and 2B are micrographs illustrating characteristics of the layer and low roughness of an example in accordance with the present invention.
Figure 2A:
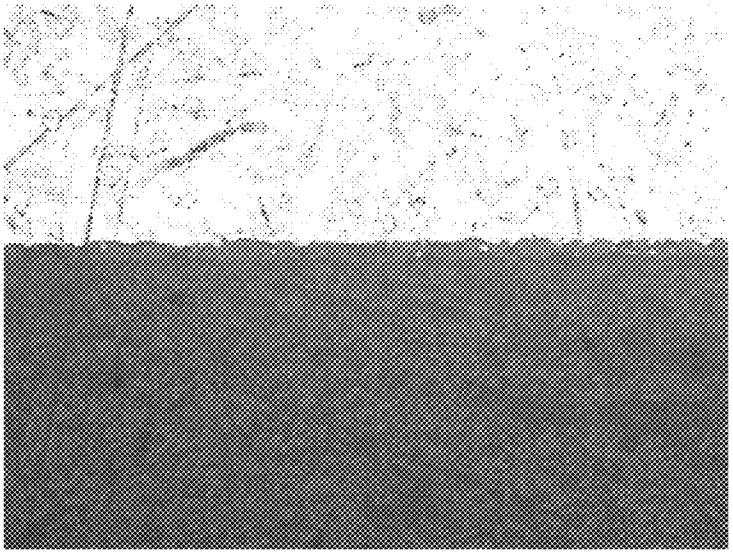

The micrographs in FIGS. 2A and 2B illustrate the characteristics of the layer and the low roughness in accordance with invention example 1. FIG. 2A documents a metallographic polished section of the anodic layer in accordance with invention example 1 at 500× magnification. FIG. 2B likewise illustrates a metallographic polished section of the layer of invention example 1 at 1000× magnification.

Further examples of high-speed anodization with electrolytes in accordance with the invention in other materials are specified below. Corresponding comparative values with a chromium trioxide-containing or chromium trioxide-free base electrolyte can be found in the above comparative examples.

Invention Example 2: Anodization of EN AW-6061 with Inventive Electrolyte without Chromium Trioxide The following reference values are given for said material with inventive electrolyte without chromium trioxide. The electrolyte compositions of invention example 2 and the three variants as well as the associated anodization parameters can be found in the following tables.

TABLE 9

Electrolyte compositions for high-speed anodization, inventive electrolyte without chromium trioxide, invention example 2 (in 3 variants)

| Designation | Invention example 2 | | |
|---|---|---|---|
| | Variant 1 Quantity in g/l | Variant 2 Quantity in g/l | Variant 3 Quantity in g/l |
| Amidosulphuric acid | 50.00 | 50.00 | 50.0 |
| Magnesium sulphate heptahydrate | 50.00 | 50.00 | 50.0 |
| Sulphuric acid conc. | 19.25 | 19.25 | 19.25 |
| Oxalic acid dihydrate | 50.00 | 50.00 | 50.00 |
| Sodium stannate trihydrate | 30.00 | 10 | |
| Molybdenum oxide | 20.00 | | 50.00 |

TABLE 10

Test parameters with inventive electrolyte without chromium trioxide, invention example 2 (in 3 variants)

| Variant (V) | Flow rate in $m^3/h$ | Temperature in ° C. | Voltage in V (unipolar) | Current density at start in $A/dm^2$ | Current density at end in $A/dm^2$ | Time in s |
|---|---|---|---|---|---|---|
| 1 | 1.4 | 10 | 60 [at 10 Hz (60 ms pulse/40 ms pause)] | 181 | 23 | 49 |
| 2 | 1.2 | 10 | 20 [at 10 Hz (60 ms pulse/40 ms pause)] | 83 | 41 | 14 |
| 3 | 3.0 | 2 | 55 [at 10 Hz (60 ms pulse/40 ms pause)] | 451 | 87 | 8 |

TABLE 11

Layer properties with inventive electrolyte without chromium trioxide, invention example 2 (in 3 variants)

| | | Layer | Roughness | | | | | | | |
|---|---|---|---|---|---|---|---|---|---|---|
| | Hardness | thickness | Ra | | Rz | | Rpk | | Rmax | |
| V | HV 0.010 | in µm | Before | After | Before | After | Before | After | Before | After |
| 1 | >400 (486) | 24.1 | 0.083 | 0.179 | 0.711 | 1.369 | 0.145 | 0.277 | 1.089 | 1.615 |
| 2 | 383 | 7.8 | 0.088 | 0.192 | 0.724 | 1.532 | 0.167 | 0.295 | 1.217 | 1.666 |
| 3 | 320 | 16 | 0.074 | 0.187 | 0.640 | 1.451 | 0.153 | 0.319 | 1.130 | 1.750 |

It can be seen that the roughness values in variant 1 are less than in variant 2 and/or variant 3. This confirms the additive effect of the additives sodium stannate and molybdenum oxide, which leads to the better result in comparison with the respective variant exclusively with sodium stannate or molybdenum oxide. However, the compositions in accordance with the invention either with sodium stannate or molybdenum oxide only are always significantly better than the pure base electrolyte (comparative example 4). The partly different layer thicknesses and/or initial roughnesses of the samples from invention example 2 and comparative example 4 must be taken into account when considering the absolute values but do not change anything about the function of said additives and the described relationships.

Figure 3B:
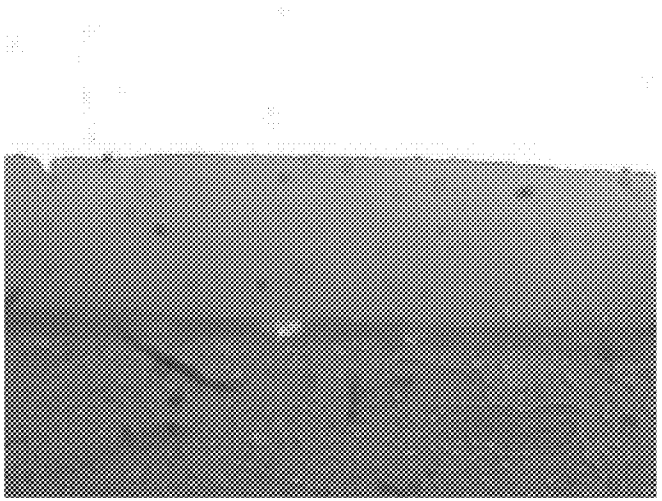
FIGS. 3A and 3B are micrographs illustrating the surface characteristics and low roughness of another example in accordance with the present invention.
Figure 3A:
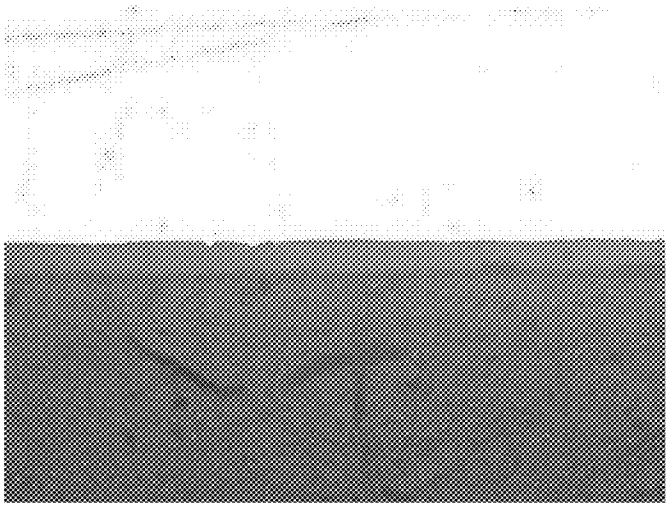

The micrographs in FIGS. 3A and 3B illustrate the surface characteristics and the low roughness according to invention example 2, variant 1. FIG. 3A shows a metallographic polished section of the anodic layer in accordance with invention example 2, V1 at 500× magnification. FIG. 3B documents the anodic layer in the metallographic polished section of invention example 2, V1 at 1000× magnification.

Invention Example 3: Anodization of EN AC-AlSi4 with Inventive Electrolyte without Chromium Trioxide The following reference values are given for said material with the inventive electrolyte without chromium trioxide. The electrolyte composition of invention example 3 and the associated anodization parameters can be found in the following tables.

TABLE 12

Electrolyte composition for high-speed anodization, inventive electrolyte without chromium trioxide, invention example 3

| Designation | Invention example 3 Quantity in g/l |
|---|---|
| Amidosulphuric acid | 50.00 |
| Magnesium sulphate heptahydrate | 50.00 |
| Sulphuric acid conc. | 19.25 |
| Oxalic acid dihydrate | 50.00 |
| Sodium stannate trihydrate | 30.00 |
| Molybdenum oxide | 20.00 |

TABLE 13

Test parameters with inventive electrolyte without chromium trioxide, invention example 3 (in 4 variants)

| Variant (V) | Flow rate in $m^3/h$ | Temperature in ° C. | Voltage in V | Current density at start in $A/dm^2$ | Current density at end in $A/dm^2$ | Time in s |
|---|---|---|---|---|---|---|
| 1 | 1.2 | 10 | 25 | 17 | 12 | 12 |
| 2 | 1.2 | 10 | 30 | 35 | 29 | 7 |
| 3 | 1.2 | 40 | 20 | 21 | 17 | 13 |
| 4 | 1.2 | 40 | 25 | 44 | 39 | 7 |

TABLE 14

Layer properties with inventive electrolyte without chromium trioxide, invention example 3 (in 4 variants)

| | | Layer | Roughness | | | | | | | |
|---|---|---|---|---|---|---|---|---|---|---|
| | Hardness | thickness | Ra | | Rz | | Rpk | | Rmax | |
| V | HV 0.010 | in µm | Before | After | Before | After | Before | After | Before | After |
| 1 | 380-390 | 6 | 0.071 | 0.795 | 1.009 | 4.212 | 0.131 | 0.411 | 1.581 | 4.456 |
| 2 | 380-390 | 6 | 0.096 | 0.569 | 1.281 | 3.795 | 0.124 | 0.321 | 1.737 | 4.067 |
| 3 | 380-390 | 6 | 0.098 | 0.990 | 1.610 | 5.092 | 0.172 | 0.475 | 2.097 | 5.329 |
| 4 | 380-390 | 6 | 0.105 | 0.712 | 1.498 | 4.233 | 0.138 | 0.335 | 1.854 | 4.531 |

Invention Example 4: Anodization of EN AC-AlSi4 with Inventive Electrolyte without Chromium Trioxide The following reference values are given for said material with inventive electrolyte without chromium trioxide. The electrolyte composition of invention example 4 and the associated anodization parameters can be found in the following tables.

TABLE 15

Electrolyte composition for high-speed anodization, inventive electrolyte without chromium trioxide, invention example 4

| Designation | Invention example 4 Quantity in g/l |
|---|---|
| Amidosulphuric acid | 50.00 |
| Magnesium sulphate heptahydrate | 50.00 |
| Sulphuric acid conc. | 19.25 |
| Oxalic acid dihydrate | 50.00 |
| Sodium stannate trihydrate | 10.00 |
| Molybdenum oxide | 20.00 |

TABLE 16

Test parameters with inventive electrolyte without chromium trioxide, invention example 4 (in 4 variants)

| Variant (V) | Flow rate in $m^3/h$ | Temperature in ° C. | Voltage in V | Current density at start in $A/dm^2$ | Current density at end in $A/dm^2$ | Time in s |
|---|---|---|---|---|---|---|
| 1 | 1.2 | 10 | 20 | 18 | 10 | 15 |
| 2 | 1.2 | 10 | 25 | 25 | 21 | 9 |
| 3 | 1.2 | 10 | 25 | 29 | 18 | 9 |
| 4 | 1.2 | 40 | 20 | 33 | 28 | 7 |

It becomes apparent from invention examples 3 and 4 that the invention can also be used with a variation of the composition of the electrolyte in accordance with the invention (amounts of sodium stannate, molybdenum oxide or combinations thereof) and a variation of the anodization parameters (temperature, voltage, current density) without having losses in anodization duration, layer thickness, layer hardness or roughness parameters.

Invention example 5: Anodization of EN AW-6061 with inventive electrolyte without chromium trioxide The following reference values are given for said material with electrolyte in accordance with the invention. The electrolyte compositions of the two variants can be found in the table below and the anodization was effected for both variants at the following parameters:

Flow rate: 1.4 $m^3/h$
Temperature: 10° C.
Voltage: 60 V (unipolar, pulsed with 10 Hz [60 ms pulse/40 ms pause])
Current density: 180 $A/dn^2$ (start), 25 $A/dn^2$ (end)
Anodization duration: 50 s)

TABLE 18

Electrolyte compositions for high-speed anodization, inventive electrolyte without chromium trioxide, invention example 5 (in 2 variants)

| | Invention example 5 | |
|---|---|---|
| Designation | Variant 1 Quantity in g/l | Variant 2 Quantity in g/l |
| Amidosulphuric acid | 50.00 | 50.00 |
| Magnesium sulphate heptahydrate | 50.00 | 50.00 |
| Sulphuric acid conc. | 19.25 | 19.25 |

TABLE 17

Layer properties with inventive electrolyte without chromium trioxide, invention example 4 (in 4 variants)

| | | Layer | Roughness | | | | | | | |
|---|---|---|---|---|---|---|---|---|---|---|
| | Hardness | thickness | Ra | | Rz | | Rpk | | Rmax | |
| V | HV 0.010 | in µm | Before | After | Before | After | Before | After | Before | After |
| 1 | 430 | 6.3 | 0.101 | 0.783 | 1.297 | 4.524 | 0.129 | 0.378 | 1.878 | 4.851 |
| 2 | 430 | 6.3 | 0.090 | 0.808 | 1.360 | 4.503 | 0.132 | 0.461 | 1.921 | 4.722 |
| 3 | 430 | 6.3 | 0.091 | 0.665 | 1.323 | 3.985 | 0.121 | 0.378 | 1.735 | 4.349 |
| 4 | 430 | 6.3 | 0.097 | 0.844 | 1.388 | 4.298 | 0.127 | 0.400 | 1.668 | 4.532 |

TABLE 18-continued

| Electrolyte compositions for high-speed anodization, inventive electrolyte without chromium trioxide, invention example 5 (in 2 variants) | | |
|---|---|---|
| | Invention example 5 | |
| Designation | Variant 1 Quantity in g/l | Variant 2 Quantity in g/l |
| Oxalic acid dihydrate | 80.00 | |
| Malonic acid | | 80.00 |
| Sodium stannate trihydrate | 30.00 | 30.00 |
| Molybdenum oxide | 20.00 | 20.00 |

TABLE 19

| Layer properties with inventive electrolyte without chromium trioxide, invention example 5 (in 2 variants) | | | | | | | | | | |
|---|---|---|---|---|---|---|---|---|---|---|
| | | Layer | Roughness | | | | | | | |
| | Hardness | thickness | Ra | | Rz | | Rpk | | Rmax | |
| V | HV 0.010 | in μm | Before | After | Before | After | Before | After | Before | After |
| 1 | >400 (481) | 22.3 | 0.087 | 0.175 | 0.698 | 1.312 | 0.135 | 0.262 | 1.007 | 1.584 |
| 2 | >400 (473) | 21.9 | 0.092 | 0.181 | 0.732 | 1.420 | 0.121 | 0.301 | 1.113 | 1.638 |

Invention Example 6: Anodization of EN AW-6061 with Inventive Electrolyte without Chromium Trioxide The following reference values are given for said material with electrolyte in accordance with the invention. The electrolyte compositions of the two variants can be found in the table below and the anodization was effected for both variants at the following parameters:

Flow rate: 1.2 $m^3/h$

Temperature: 10° C.

Voltage: 20 V (unipolar, pulsed with 10 Hz [60 ms pulse/40 ms pause])

Current density: 82 $A/dm^2$ (start), 40 $A/dm^2$ (end)

Anodization duration: 15 s)

TABLE 20

| Electrolyte compositions for high-speed anodization, inventive electrolyte without chromium trioxide, invention example 6 (in 2 variants) | | |
|---|---|---|
| | Invention example 6 | |
| Designation | Variant 1 Quantity in g/l | Variant 2 Quantity in g/l |
| Amidosulphuric acid | 50.00 | 50.00 |
| Magnesium sulphate heptahydrate | 50.00 | 50.00 |
| Sulphuric acid conc. | 19.25 | 19.25 |
| Oxalic acid dihydrate | 25.00 | |
| Malonic acid | | 25.00 |
| Sodium stannate trihydrate | 10.00 | 10.00 |

TABLE 21

Layer properties with inventive electrolyte without chromium trioxide, invention example 6 (in 2 variants)

| | | Layer | Roughness | | | | | | | |
|---|---|---|---|---|---|---|---|---|---|---|
| | Hardness | thickness | Ra | | Rz | | Rpk | | Rmax | |
| V | HV 0.010 | in µm | Before | After | Before | After | Before | After | Before | After |
| 1 | 383 | 7.8 | 0.091 | 0.192 | 0.695 | 1.489 | 0.143 | 0.290 | 1.196 | 1.801 |
| 2 | 375 | 8.3 | 0.105 | 0.210 | 0.774 | 1.558 | 0.160 | 0.288 | 1.097 | 1.744 |

The invention claimed is:

1. A composition for selective anodization, said composition comprising:

amidosulphuric acid, magnesium sulphate and concentrated sulphuric acid as a base electrolyte, and additionally sodium stannate and/or molybdenum oxide, wherein the composition is free of chromium trioxide.

2. The composition as claimed in claim 1, wherein concentrated sulphuric acid in a range from 5 to 150 g/L, magnesium sulphate hydrate in a range from 5 to 200 g/L and amidosulphonic acid in a range from 5 to 200 g/L are contained.

3. The composition as claimed in claim 2, wherein 0.1 to 100 g/L sodium stannate is contained.

4. The composition as claimed in claim 3, further comprising dicarboxylic acid, and wherein the sodium stannate is contained pre-dissolved in 5 to 100 g/L of the dicarboxylic acid.

5. The composition as claimed in claim 4, wherein 0.1 to 100 g/L molybdenum(VI) oxide is contained.

6. The composition as claimed in claim 5, wherein 50 g/L amidosulphuric acid, 50 g/L magnesium sulphate heptahydrate, 19.25 g/L concentrated sulphuric acid, 30 g/L sodium stannate, 50 g/L oxalic acid dihydrate and 20 g/L molybdenum(VI) oxide are contained.

7. The composition as claimed in claim 1, wherein 0.1 to 100 g/L sodium stannate is contained.

8. The composition as claimed in claim 7, further comprising dicarboxylic acid, and wherein the sodium stannate is contained pre-dissolved in 5 to 100 g/L of the dicarboxylic acid.

9. The composition as claimed in claim 1, wherein 0.1 to 100 g/L molybdenum(VI) oxide is contained.

10. The composition as claimed in claim 1, wherein 50 g/L amidosulphuric acid, 50 g/L magnesium sulphate heptahydrate, 19.25 g/L concentrated sulphuric acid, 30 g/L sodium stannate, 50 g/L oxalic acid dihydrate and 20 g/L molybdenum(VI) oxide are contained.

11. A method for selective anodization of a substrate, comprising:

providing a substrate having a surface which is to be selectively coated, wherein the substrate is arranged in a tool and forms a coating cell;

selectively bathing the surface with a composition for selective anodization as claimed in claim 1; and applying an electric current between substrate and tool for selective anodization of the surface.

12. The method as claimed in claim 11, wherein the current density is between 10-500 A/dm2.

13. The method as claimed in claim 12, wherein the temperature of the composition is between −5 and +55 degrees Celsius.

14. The method as claimed in claim 13, wherein a flow rate of the composition in the chamber is between 0.1 and 15 $m^3$/h.

15. The method as claimed in claim 14, wherein said applying an electric current comprises applying an electric current for between 5 and 60 s.

16. The method as claimed in claim 15, wherein said applying an electric current comprises applying a voltage between 10 V and 120 V, and wherein it can be present as a DC voltage or a pulsed voltage.

17. The method as claimed in claim 11, wherein the temperature of the composition is between −5 and +55 degrees Celsius.

18. The method as claimed in claim 11, wherein a flow rate of the composition in the chamber is between 0.1 and 15 10 $m^3$/h.

19. The method as claimed in claim 11, wherein said applying an electric current comprises applying an electric current for between 5 and 60 s.

20. The method as claimed in claim 11, wherein said applying an electric current comprises applying a voltage between 10 V and 120 V, and wherein it can be present as a DC voltage or a pulsed voltage.

* * * * *